US007284329B1

(12) United States Patent
King

(10) Patent No.: US 7,284,329 B1
(45) Date of Patent: Oct. 23, 2007

(54) FOLDING KNIFE WITH CANTILEVERED RETAINER

(75) Inventor: Randall S. King, Asheville, SC (US)

(73) Assignee: Randall King Knives, Inc., Asheville, NC (US)

( * ) Notice: Subject to any disclaimer, the term of this patent is extended or adjusted under 35 U.S.C. 154(b) by 255 days.

(21) Appl. No.: 11/014,495

(22) Filed: Dec. 16, 2004

(51) Int. Cl.
*B26B 1/04* (2006.01)
*B26B 3/06* (2006.01)

(52) U.S. Cl. ..... 30/161; 30/158; 30/159; 30/160

(58) Field of Classification Search ..... 30/161, 30/160, 157, 159, 158, 153, 155, 156, 331, 30/330; 29/434, 525.1; 7/118, 120; D8/98, D8/99

See application file for complete search history.

(56) References Cited

U.S. PATENT DOCUMENTS 592,612 A * 10/1897 Johnson ..... 30/159
2,197,136 A * 4/1940 Wallace et al. ..... 30/159
2,250,290 A * 7/1941 Berg ..... 30/160
2,808,646 A * 10/1957 Lohr et al. ..... 30/159
3,783,509 A * 1/1974 Lake ..... 30/161
4,347,665 A * 9/1982 Glesser ..... 30/161
4,447,950 A 5/1984 Mizelle
4,451,982 A * 6/1984 Collins ..... 30/161
4,535,539 A * 8/1985 Friedman et al. ..... 30/161
5,515,610 A 5/1996 Levin et al.
5,692,304 A * 12/1997 Campbell ..... 30/161
5,915,792 A * 6/1999 Sakurai ..... 30/161
6,145,202 A 11/2000 Onion
6,308,420 B1 10/2001 Moser
6,363,615 B1 4/2002 Moser
6,397,476 B1 6/2002 Onion
6,651,344 B2 11/2003 Cheng
6,729,029 B1 * 5/2004 Chu ..... 30/161
6,810,588 B1 * 11/2004 Cheng ..... 30/153
6,834,432 B1 * 12/2004 Taylor, Jr. ..... 30/161
2003/0140500 A1 * 7/2003 Cheng ..... 30/159
2003/0226260 A1 12/2003 Sullivan
2004/0020058 A1 * 2/2004 Vallotton ..... 30/160
2004/0261272 A1 * 12/2004 Moser ..... 30/160
2005/0072004 A1 * 4/2005 Carter ..... 30/158
2006/0064877 A1 * 3/2006 Vallotton et al. ..... 30/153

* cited by examiner

*Primary Examiner*—Boyer D. Ashley
*Assistant Examiner*—Ghassem Alie
(74) *Attorney, Agent, or Firm*—Leatherwood Walker Todd & Mann, P.C.; Thomas W. Epting

(57) ABSTRACT

A folding knife having a handle and a blade pivotally attached to the handle for pivoting between a retracted position and an extended position. A cantilever member is connected to the handle, and the cantilever member includes a free end. The blade includes a first stop and a second stop, and the first stop and the cantilever member are configured such that upon the blade being in the retracted position, the free end of the cantilever member bears against the first stop to selectively maintain the blade in the retracted position.

1 Claim, 5 Drawing Sheets

84A
84
86
76
76'
92
78

84
76
78
90
B 84
44
B
46
50
76
78

FOLDING KNIFE WITH CANTILEVERED RETAINER

BACKGROUND OF THE INVENTION

The present invention relates generally to a folding knife having a cantilever member for selectively retaining the blade of the folding knife in a retracted position.

Folding knives continue to be popular due to their small size, when the blade is in the retracted position, and their functionality, when the blade is in an extended position. Folding knives may include a blade which is manually withdrawn from the folded position to the extended position, or may include means for automatically propelling the blade from the retracted position to the extended position upon actuation of a trigger mechanism.

Another type of folding knives are known as assisted opening folding knives and ordinarily require the user to manually move the blade through a predetermined angle before a mechanism is activated to propel the blade to the extended position.

Various means are available for maintaining the blade in the folded, or retracted, position, typically within or adjacent to the handle of the folding knife. The purpose of such means are to prevent the blade from inadvertently opening or otherwise moving from the retracted position. Maintenance of the blade in the retracted position until it is desired to be used can be significant, in that should the blade open in an uncontrolled manner, personal injury and/or damage to property could occur.

SUMMARY OF THE INVENTION

Generally, the present invention includes a folding knife having a handle, and a blade pivotally attached to the handle for pivoting between a retracted position (generally adjacent the handle) and an extended position (generally extending from the handle). A cantilever member is connected to the handle, the cantilever member defining a free end.

The blade includes a first stop and a second stop, and the first stop and the cantilever member are configured such that upon the blade being in the retracted position, the free end of the cantilever member bears against the first stop to selectively maintain the blade in the retracted position.

More specifically, the present invention includes, in one preferred embodiment, a biasing element connected between the handle and the blade for urging the blade towards said extended position.

The handle may define a blade cavity within a blade opening and a back portion generally opposite the opening, and the cantilever member may be a rod defining a cantilever centerline, with the first stop also defining a centerline. The first stop and the cantilever member may thus be configured such that upon the blade being in the retracted position, the cantilever centerline extends between the centerline of the first stop and the back of the handle.

The first stop, in one preferred embodiment, defines a curved profile, and the free end of the cantilever member, having a rounded free end, contacts the curved profile upon the blade being in the retracted position.

A preferred embodiment of the folding knife includes the cantilever member being configured to contact and slide against the first stop as the blade moves between the retracted position and the extended position.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
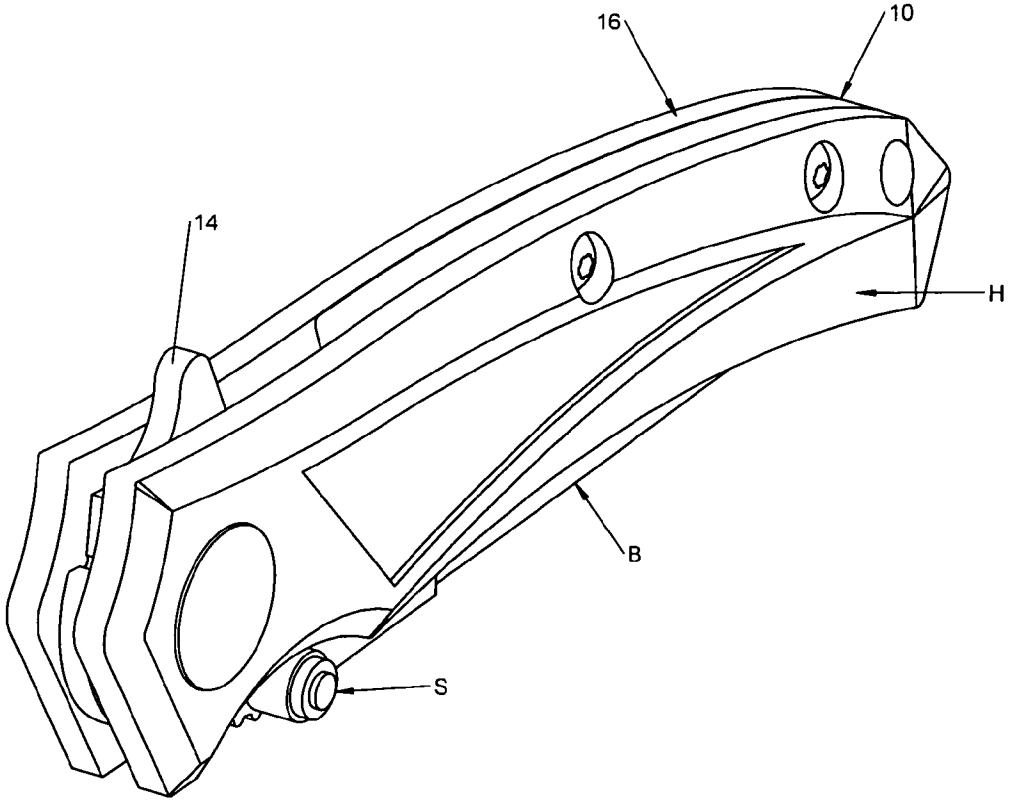
FIG. 1 is a perspective view of a folding knife having a cantilever retainer constructed in accordance with the present invention.

The accompanying drawings and the description which follows set forth this invention in its preferred embodiment. However, it is contemplated that persons generally familiar with folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, a folding knife having a cantilever retainer constructed in accordance with the present invention is indicated generally in the figures by reference character 10.

Turning to FIG. 1 of the drawings, folding knife 10 is illustrated with blade, generally B, in a retracted position. Blade B is pivotally connected to a handle, generally H, via a pivot connection. A blade or thumb stud, generally S, is provided on blade B to facilitate opening of blade B from the retracted position by the user's fingers while holding handle H, and is preferably configured to permit the user to open the blade while using one hand. Blade B also includes an ear 14 projecting upwardly from the backside, generally 16, of handle H, for engagement by the user's fingers or thumb to open blade B in an alternate manner.

Figure 2:
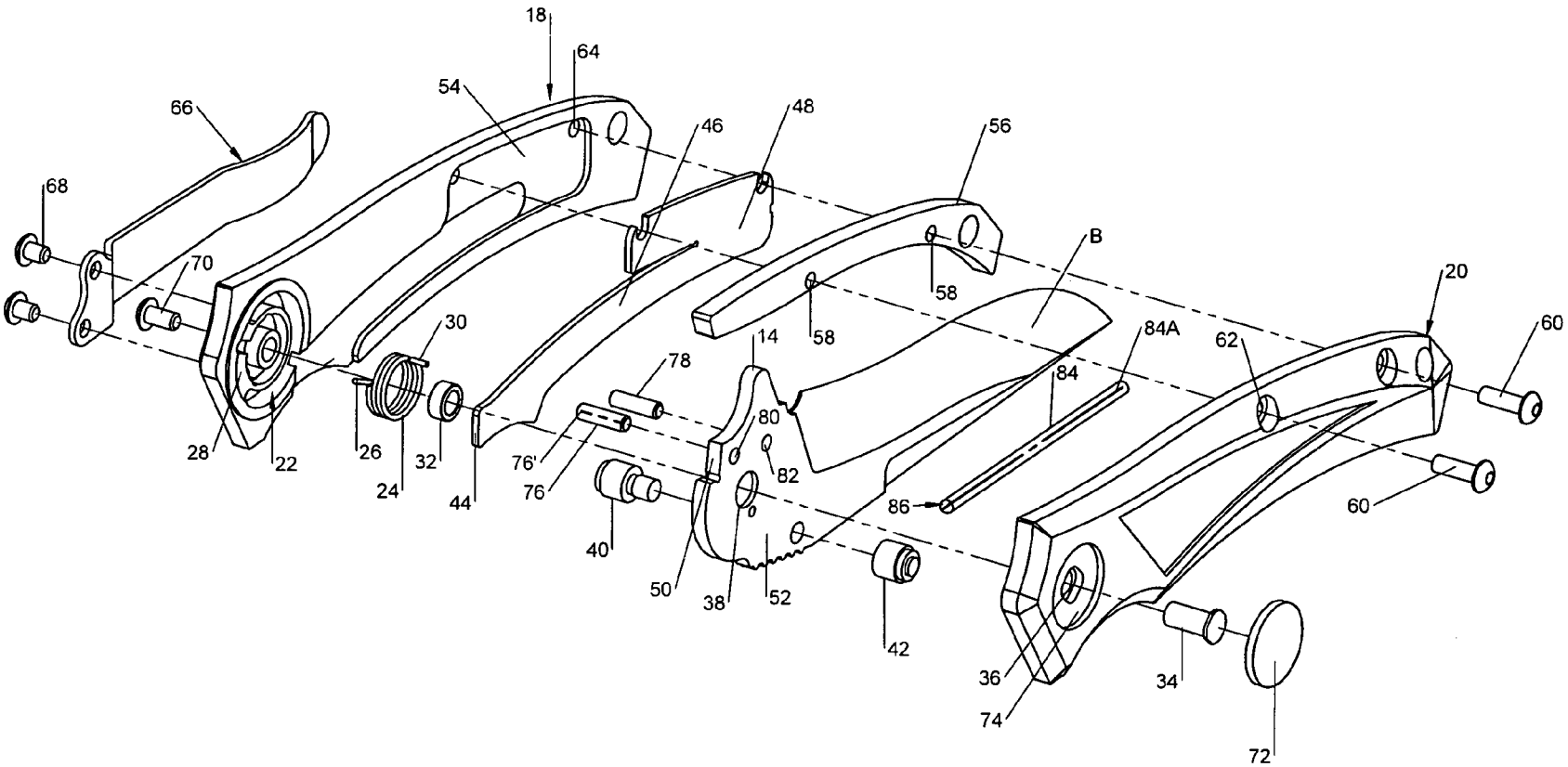
FIG. 2 is an exploded in view of the folding knife illustrated in FIG. 1.

As shown in FIG. 2, handle H includes a right handle portion, generally 18, and a left handle portion, generally 20. Right handle portion 18 includes a generally cylindrical receptacle 22 for receipt of a torsion spring 24. Torsion spring 24 has a leg 26 engagable with the notch 28, and a finger 30 for engaging blade B and urging blade B from the retracted position towards the extended position.

A blade bushing 32 is provided for facilitating pivoting of blade B between the retracted and extended positions and receives a blade pivot, specifically a female center pivot member 34, which passes through an opening 36 in left handle portion 20 and through pivot hole 38 of blade B. Blade stud, or thumb stud, S includes cooperating portions 40 and 42 which connect to one another to provide a stud S extending outwardly from each side of blade B.

Figure 3:
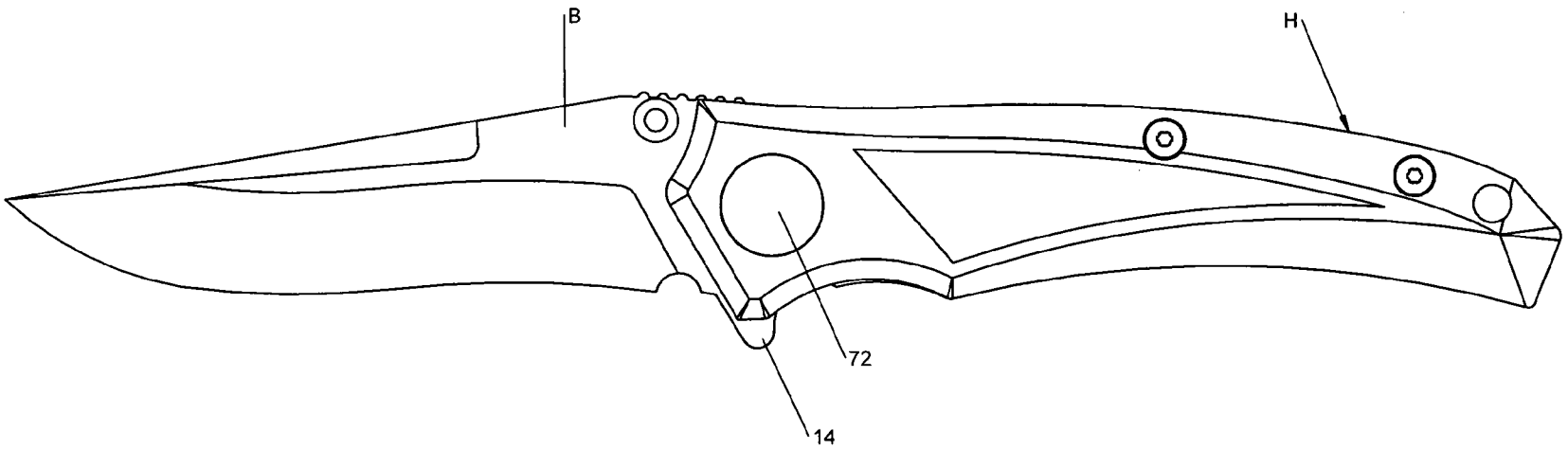
FIG. 3 is a side elevational view of the folding knife illustrated in FIGS. 1 and 2, with a blade in the extended position.
Figures 4A, 4B, 4C:
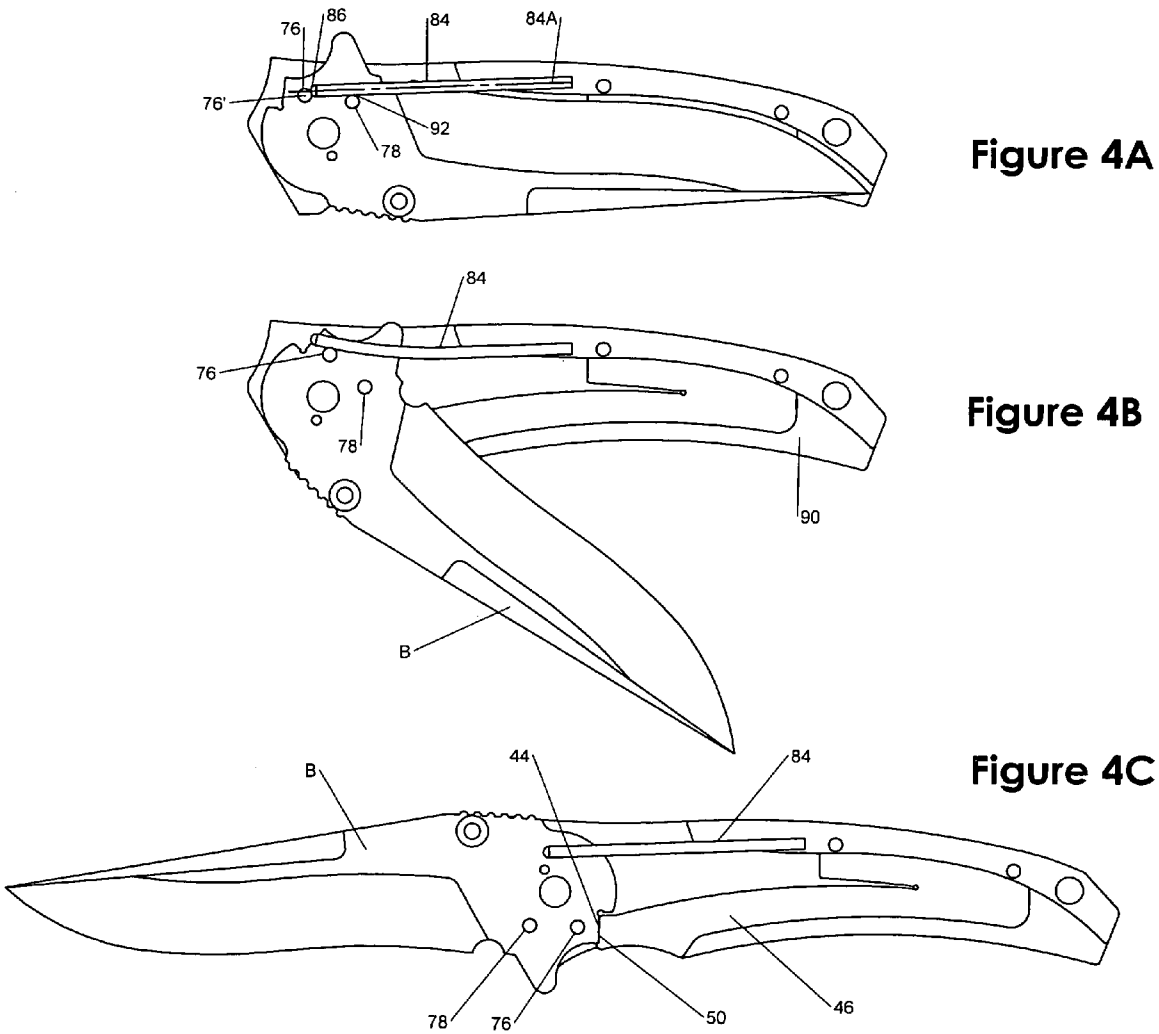
FIG. 4A is a sectional view of the folding knife illustrated in FIGS. 1 through 3, with the blade in a retracted position, and a cantilever member having a free end bearing against a first stop.
FIG. 4B is a sectional view of the folding knife illustrated in FIG. 4A, wherein the blade is at an intermediate position between the retracted and extended positions, and a lateral portion of the cantilever member bearing against the first stop.
FIG. 4C is a sectional view of the folding knife illustrated in FIGS. 4A and 4B, with the blade in the extended position, and with the cantilever member out of contact with the first and second stops.

Upon blade B being in an extended position, as shown in FIGS. 3 and 4C, the extreme end 44 of a leaf spring 46 of a liner lock member 48 engages with edge 50 of tang 52 of blade B in order to automatically lock blade B in the extended position, once blade B has been moved to that position. FIG. 4C illustrates the engagement of the extreme end 44 of leaf spring 46 and edge 50 of blade B for blocking the inadvertent or uncontrolled return of blade B to the retracted position.

In order to move blade B from the extended position to the retracted position, the user would simply depress leaf spring 46 into a recess 54 (FIG. 2) defined in right handle portion 18, and blade B would then be manipulated by the user to pivot it back to the retracted position.

A spine member 56 is interposed between right handle portion 18 and left handle portion 20, and includes bores 58 through which screws 60, or other fastener, pass in attaching left handle portion 20 (through holes 62) to right handle portion 18 (via holes 64).

A belt or pocket clip, generally 66, is provided and is attached with screws 68 to right handle portion 18.

A male center pivot member 70 mates with center pivot 34 to secure center pivot 34. Medallion 72 is provided for covering center pivot 34, and is received in a recess 74 of left handle portion 20.

First and second blade stops, or index dowels, 76 and 78, having generally cylindrical profiles, are secured into bores 80 and 82, respectively, of blade tang 52. A cantilever member, or detent bar, 84, is provided and is secured in left handle member 20, or spine member 56. Detent bar 84 includes a free end, generally 86, which is preferably rounded. Detent bar 84 extends along the left side (as viewed in FIG. 2) of blade B. It is to be understood that although the cantilever member is illustrated herein as a rod or bar (FIG. 5), the term "cantilever member" as used herein shall be construed to cover a variety of members and structures, including, but not limited to, a post, finger, projection, tooth, knob, arm, spring, leg, rib, strut, or the like.

As shown in FIG. 4A, when blade B is in a retracted position, the free end 86 of detent bar 84 bears against first stop 76. First stop 76 includes a centerline 76', and detent bar 84 also defines its own centerline 84A. In one preferred embodiment, when blade B is in the retracted position, the centerline 84A of detent bar 84 is preferably slightly above the centerline 76' of first stop 76, in a direction towards the back 16 of handle H, and this arrangement causes detent bar 84 to provide an outward force against first stop 76. Since first stop 76 is positioned to the left (as viewed in FIG. 4A) of the center of blade B center pivot 34, and is also spaced above blade center pivot 34, blade B is restrained from outward movement from the blade cavity 90 (FIG. 4B) defined by handle H. Also, as shown on FIG. 4A, second stop 78 bears against a lateral portion 92 of detent bar 84, and this arrangement serves to properly position free end 86 of detent bar 84 and first stop 76 with respect to one another when blade B is in the retracted position. In other words, second stop 78 serves to properly register free end 86 against the first stop 76.

Second stop 78, through its engagement with the lateral portion 92 of detent bar 84, also serves to prevent blade B from being pushed too far inwardly into blade cavity 90, when blade B is moved to the retracted position.

FIG. 4B illustrates blade B in an intermediate position between the retracted and extended positions. In such intermediate position, free end 86 of detent bar 84 has risen above first stop 76, and a lateral portion 92 of detent bar 84 bears against first stop 76 in a sliding arrangement. The bearing of detent bar 84 against first stop 76 during opening of blade B serves to provide resistance to blade B as blade B is moved from the retracted to intermediate positions. This provides for a controlled opening of blade B, such that blade B does not simply fall out or swing loosely between the retracted and extended positions, but instead, requires the user to exert some force to move blade B to the extended position, or, to the position generally shown in FIG. 4B, at which time, if a biasing means such as torsion spring 24, or some other spring or biasing member, is used, such biasing means can take over and propel blade B to the extended position. It is to be understood that the present invention can be used on manually operated folding knives, i.e., folding knives other than automatic or assisted opening knives, and also on automatic and assisted opening knives.

FIG. 4C illustrates blade B in the fully extended position, and in such position, as noted above, extreme end 44 of leaf spring 46 of liner lock 48 bears against edge 50 of blade tang 52. It should also be noted that in the extended position of blade B, detent bar 84 is free from contact of both first and second stops 76, 78, respectively.

Figure 5:
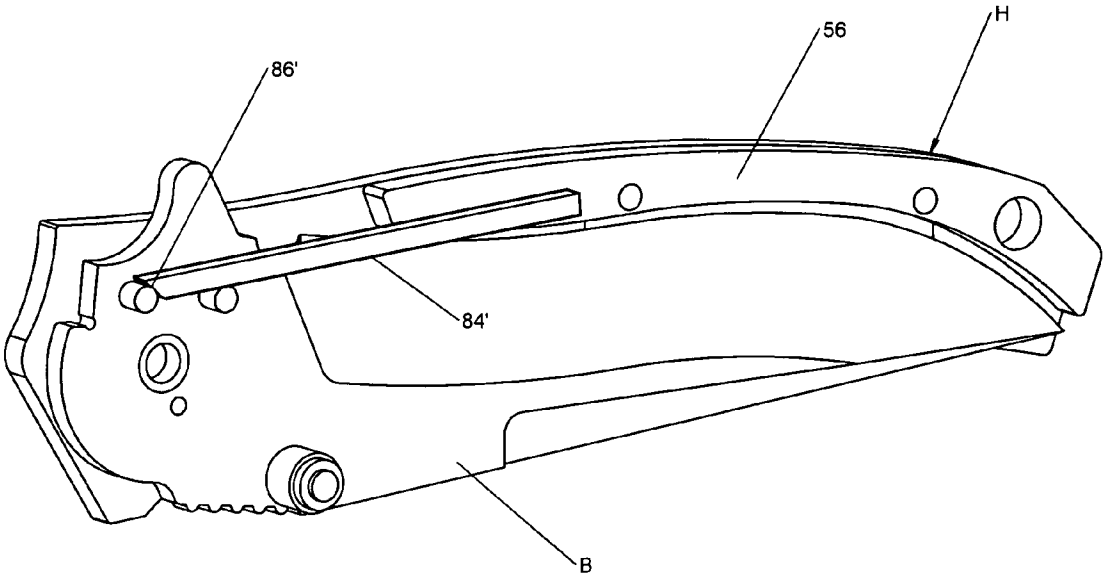
FIG. 5 is a sectional view of an alternate embodiment of a folding knife having a cantilever retainer constructed in accordance with the present invention, the cantilever member being of generally rectangular cross-section and having a slanted free end.

FIG. 5 illustrates an alternate embodiment of the present invention wherein detent bar 84' has a generally rectangular cross-section and a slanted free end 86', rather than the generally cylindrical shape of detent bar 84' disclosed above, which preferably has a rounded end. Operation of the alternate embodiment illustrated in FIG. 5 is otherwise the same as discussed above.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A folding knife, comprising:

a handle defining an opening and a back portion generally opposite said opening;

a blade pivotally attached to said handle for pivoting between a retracted position, generally in said opening of said handle, and an extended position, generally extending from said handle;

a biasing element connected to said blade for urging said blade towards said extended position;

an elongated cantilever member connected to said handle;

said cantilever member defining a free end, said free end being rounded;

said cantilever member further defining a lateral surface spaced from said free end;

said blade including a first stop and a second stop;

said first stop including a curved profile; and said first stop, said second stop, and said cantilever member being configured such that upon said blade being in said retracted position, said free end of said cantilever member bears against said curved profile of said first stop and said lateral portion of said cantilever member bears against said second stop to selectively maintain said blade in said retracted position.

* * * * *